United States Patent [19]

Thomas

[11] Patent Number: 4,795,153

[45] Date of Patent: Jan. 3, 1989

[54] GOLF CLUB

[76] Inventor: Joseph B. Thomas, 1489 Turner Rd., Colorado Springs, Colo. 80918

[21] Appl. No.: 62,610

[22] Filed: Jun. 15, 1987

[51] Int. Cl.[4] ..... A63B 53/04; A63B 53/02

[52] U.S. Cl. ..... 273/81.3; 273/80 A; 273/80 B; 273/80 C; 273/168

[58] Field of Search ..... 273/80 C, 81.3, 77 R, 273/77 A, 80 A, 80 B, 168, 80.2, 80.9

[56] References Cited

U.S. PATENT DOCUMENTS 4,621,816 11/1986 Leek ..... 273/81.3

*Primary Examiner*—George J. Marlo

*Attorney, Agent, or Firm*—Timothy J. Martin; J. Preston Oxenham

[57] ABSTRACT

A golf club particularly adapted as a putter includes a club head, a handle portion and a shaft structure interconnecting the club head and the handle portion. The shaft structure includes a lower shaft portion and an intermediate shaft portion. The lower shaft portion is preferably formed of two parallel lower shaft sections oriented in side-by-side relation perpendicular to the club head to define a lower shaft plane that contains the axis of the club head and that is perpendicular to the attack plane of the golf club. The handle portion is offset from the lower shaft axis by the intermediate shaft portion so that the golfer's view line is not obstructed by the handle portion or the golfer's hands during a golf stroke. The handle axis is preferably in the lower shaft plane and is parallel to the lower shaft axis. The lower shaft sections may either be independent cylindrical elements or be constructed by collapsing a diametric portion of a hollow tube along its longitude to form a pair of parallel tubular elements interconnected by a longitudinal web.

23 Claims, 2 Drawing Sheets

GOLF CLUB

BACKGROUND OF THE INVENTION

The present invention relates to the construction of golf clubs and is specifically directed to the construction of a golf putter. The golf putter according to the present invention aids a golfer in the alignment of the golf club and the golf ball and provides the golfer with a putter having exceptional balance and force distribution characteristics.

Since its early beginnings approximately 800 years ago, golf has grown to be one of the world's great past times and enjoys popularity as a recreational sport throughout the world. Indeed, virtually every country in the world not only has residents who enjoy this sport but also has numerous golf courses specifically constructed for this popular recreational activity. Golf is played on a golf course which is specifically designed for the game and which comprises a plurality of holes for play. Each hole has a tee from which a golf bali is initially placed for play, a fairway and a cup into which the ball is to be stroked. The cup is surrounded by a putting green. The fairway is flanked by a rough, and obstacles such as water hazards and sand bunkers offer impediments to be avoided during play.

In the game of golf, a golfer typically employs a set of clubs, including clubs known as "woods" and "irons". The clubs are arranged in numerical order of increasing loft, that is, the angle of club face from the vertical. These clubs are designed to propel a golf ball a substantial distance as the golfer seeks to reach a putting green from the golf tee. A set of golf clubs also includes a putter which is specifically constructed. for use in striking the golf ball accurately towards the cup once it has reached the putting green. Other specialized irons, such as pitching wedges and sand wedges, may also be included in such a set of clubs.

Quite naturally, over the course of history, there have been increasing improvements in the technology associated with the construction of golf clubs. Such improvements have been in size, configuration, structural materials and the like. The general construction of such a golf club includes a handle portion adapted to be grasped by the golfer, a shaft extending linearly downwardly from the handle portion and a club head at the end of the shaft opposite the handle portion. The club head extends transversely to the shaft and has a neck portion located at one end thereof which neck portion is connected by a hosel to the shaft. The golfer grips the handle portion and faces a direction transversely of the desired flight of the golf ball, and the golfer addresses the golf ball by placing the club head adjacent the lie of the ball. The golfer then swings the golf club in a sweeping arc generally in a plane parallel to the golfer's body that may be described as the attack plane for a golf club and strikes the ball with the face of the club head at a desired amount of force to achieve an intended stroke. The arcuate swing of the club in the attack plane may find the club head travelling in almost a complete circle where a long shot is desired, but may be a short arcuate stroke as well, such as when the golf ball is putted on the green.

The present invention is thus directed to improvements in the construction of these golf clubs, and, in particular, in the geometric orientation of the construction elements. The present invention is especially adapted as an improvement in the structure and organization of a golf putter.

SUMMARY OF THE INVENTION

It is an object of the present invention to provide a new and useful golf club which may be used by a golfer in playing the game of golf.

It is a further object of the present invention to provide a golf club having an offset handle portion such that the hands of the golfer and the handle portion of the golf club do not restrict the golfer's view of the golf ball when the golf ball is addressed and stroked.

It is further an object of the present invention to provide a golf club having a lower shaft portion which, by its construction and orientation, helps align the center of the club head with the golf ball as it is being addressed and stroked.

It is yet another object of the present invention to provide a golf club which has good balance and weight.

Yet a further object of the present invention is the provision of a golf club that has a lower shaft portion which more uniformly distributes the forces of impact of a golf ball throughout the golf club.

A still further object of the present invention is to provide a golf putter which may be used with equal facility by both left-handed and right-handed players, which golf putter includes an offset handle portion which does not restrict the view of the golf ball when the club is used to address the ball during a particular putting stroke.

To accomplish these objects, the present invention provides a golf club that broadly includes four sections. A handle portion is located at one end of the club, and a club head is located at the end of the golf club opposite the handle portion. A lower shaft portion is attached to the club head and extends upwardly from the club head and is joined to the handle portion by an intermediate shaft portion. In this invention, the handle portion is offset from the lower shaft portion so that the handle portion and the golfer's hands will not restrict the golfer's view line when a golf ball is addressed. Further, the present invention comtemplates a lower shaft portion formed as two elongated cylindrical sections which are positioned in side-by-side relation along the length of the club head and transversely to the attack plane.

With more particularity, the preferred form of the present invention includes a club head located at the first end of the golf club and which has a head axis. The club head is oriented with the head axis positioned transversely of the length of the golf club. A handle portion is located at a second end of the golf club opposite the first end and is adapted to be grasped by the golfer's hands. The lower shaft portion is preferably formed of first and second lower shaft sections which respectively have first and second shaft section axes. The lower shaft sections are positioned in side-by-side relation to the direction of the head axis such that the first and second lower shaft section axes are located on either side of a common, lower shaft axis. The lower shaft axis and the lower shaft section axes define a lower shaft plane which is transverse to the attack plane. The first and second lower shaft sections are attached to the club head in a substantially perpendicular manner. The intermediate shaft portion then interconnects the lower shaft portion and the handle portion such that the handle portion has a handle axis and is offset from the lower shaft axis.

Additional features are described and found in the preferred embodiment of the present invention. Particularly, it is preferred that the first and second lower shaft sections by cylindrical in shape. In one embodiment of the present invention these lower shaft sections are independent tubular elements. In another embodiment of the invention, the lower shaft portion is formed of a common tubular member that is diametrically collapsed along a portion of its length such that a collapsed portion separates the tubular member into a pair of tubular portions spaced apart by a web defined by the collapsed portion. This web may be provided with a plurality of holes.

As noted above, the handle portion is offset from the lower shaft axis a sufficient distance so as not to restrict the view line of the golfer along the lower shaft axis. This offset may be accomplished such that the handle portion lies in the lower shaft plane, thus allowing it to be used with equal facility by both right-handed and left-handed golfers. In one embodiment, though, the handle portion is offset both from the lower shaft plane and with respect to a plane which is perpendicular to the lower shaft plane and which contains the lower shaft axis. Preferably, the handle axis is parallel to the lower shaft axis so that it, too, is perpendicular to the head axis. When constructed as a putter, the golf club head has first and second attack faces, on each side of the lower shaft plane with the lower shaft plane containing the head axis. Further, it is desirable that the lower shaft portion and the handle portion be constructed of approximately equal lengths and weighted such that the center of mass of the golf club is located geometrically within the intermediate shaft portion.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention is directed to an improved golf club structure which may be employed by a person in playing the recreational game of golf. While it should be appreciated that this invention is described with respect to a golf putter, to which its construction is particularly adapted, the concepts contained in this invention are adaptable to other golf clubs which ordinarily make up the set of clubs used in playing golf. As such, the present invention is particularly directed to a new and useful golf club that has excellent balance, which is constructed to uniformly apply a striking force to the ball and which is constructed to assist visual alignment of the club shaft with a golf ball when the ball is addressed for the golf stroke.

Figure 1:
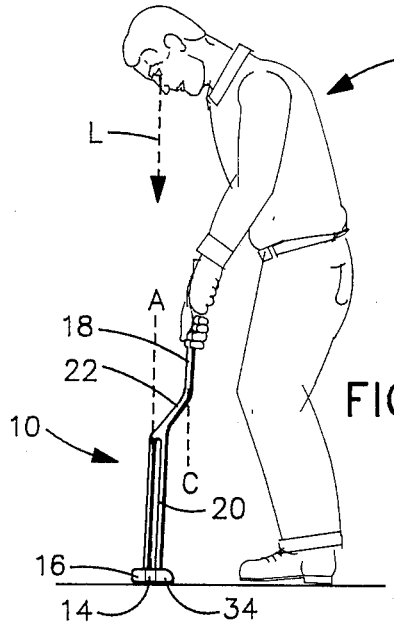
FIG. 1 is side view in elevation of golfer utilizing the golf club according to the preferred embodiment of the present invention.

In FIG. 1, golf club 10 according to the preferred embodiment of the present invention is shown grasped by the hands of golfer 12. In this typical posture, a golfer addresses golf ball 14 with the golfer's body facing a direction transversely to the desired direction of flight of the golf ball. The golfer normally swings the golf club 10 in an attack plane that corresponds to the direction that the golf ball is to be propelled. When addressing the golf ball 14, the golfer places club head 16 of club 10 adjacent golf ball 14 and sights down view line L in aligning the ball for the golf stroke. The golfer then arcuately swings the club away from the ball 14 in the attack plane after which the golfer advances the club to strike the ball with a desired force.

Figure 2:
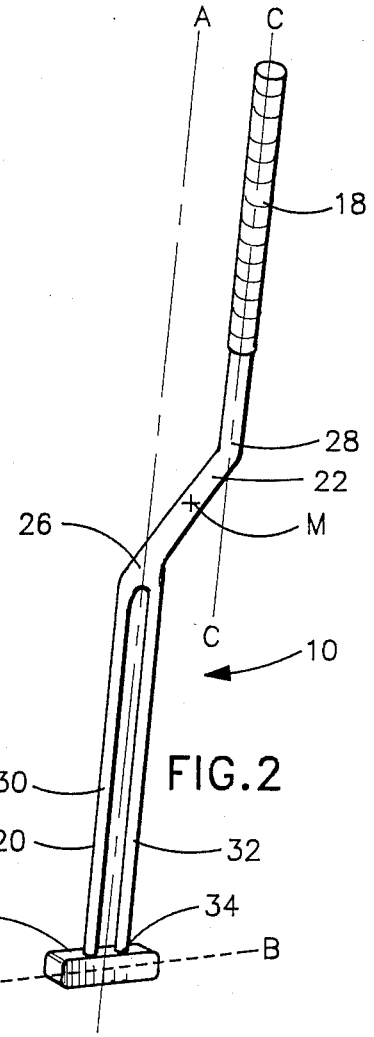
FIG. 2 is a perspective view of the golf club according the preferred embodiment of the present invention.
Figure 3:
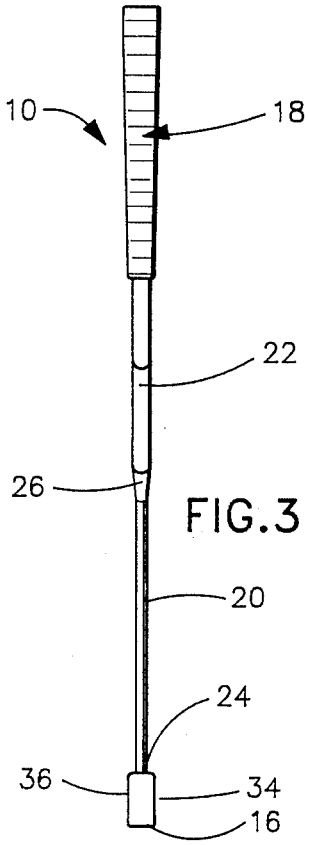
FIG. 3 is an end view in elevation showing the golf club according to the preferred embodiment of the present invention.
Figure 4:
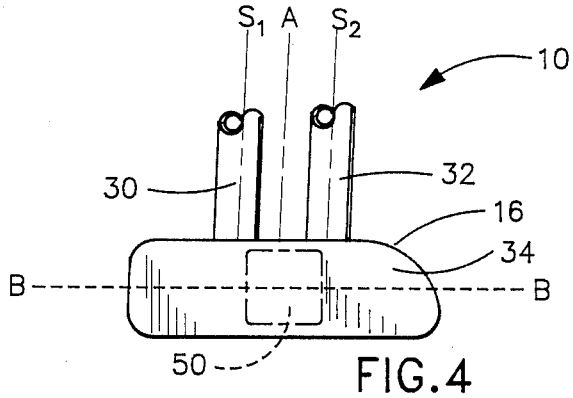
FIG. 4 is a side view of the club head and lower shaft sections of the invention shown in FIGS. 2 and 3.
Figure 5:
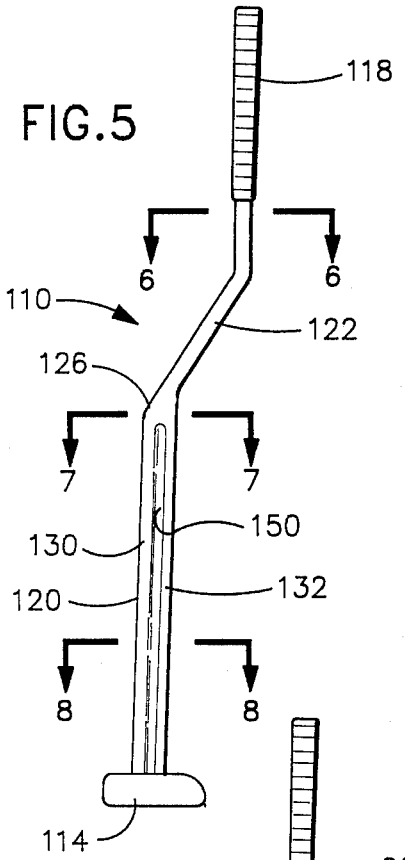
FIG. 5 is a side view in elevation showing a first alternate embodiment of a golf club according to the present invention.
Figure 6:
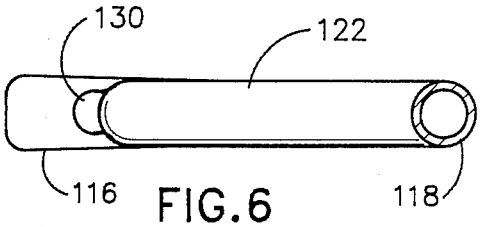
FIG. 6 is cross-sectional view taken about lines 6—6 of FIG. 5.
Figure 7:
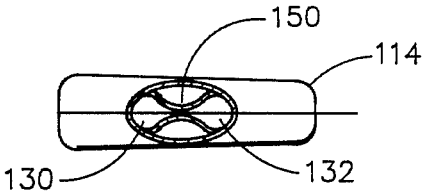
FIG. 7 is a cross-sectional view taken about lines 7—7 of FIG. 5.
Figure 8:
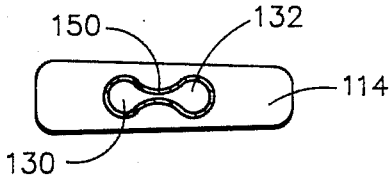
FIG. 8 is a cross-sectional view taken about lines 8—8 of FIG. 5.

As noted above, it is the intent of the present invention to provide an improved golf club 10, the structure of which is best shown in FIGS. 2–4. In these figures, golf club 10 includes club head 16 located at a first end of club 10 and a handle portion 18 located at a second end of golf club 10 opposite club head 16. Golf club 10 includes a lower shaft portion 20 and an intermediate shaft portion 22 which interconnects lower shaft portion 20 to handle portion 18. Lower shaft portion 20 is thus attached at a lower end 24 to club head 14 and at an upper end 26 to intermediate shaft portion 22. A lower end 28 of handle portion 18 is secured to an upper end of intermediate shaft portion 22, all as is shown in FIG. 2. Furthermore, lower shaft portion 20 is preferably formed of first and second lower shaft sections 30 and 32, which are positioned in side-by-side relation to the direction of the axis of club head 16 as more thoroughly described below.

It should be understood that the geometrical orientation of the various parts of the golf club 10 are important with respect to the present invention. Thus, from a review of FIGS. 1–4, it may be appreciated that lower shaft sections 30 and 32 have shaft section axes $S_1$ and $S_2$, respectively. Each of these shaft sections 30 and 32 are positioned in side-by-side relation so that they are on either side of a lower shaft axis A. Thus, axes $S_1$, $S_2$ and A define a common lower shaft plane. Golf club head 14 is oriented transversely the length of golf club 10 along a head axis B so that head axis B is parallel to the lower shaft plane defined by axes $S_1$, $S_2$ and A. Furthermore by this orientation, the lower shaft plane, as well as head axis B, are oriented transversely to the attack plane. Handle portion 18 has a handle axis C that extends in a longitudinal direction through handle portion 18. Handle portion 18 is offset from the lower shaft axis A as described more thoroughly below.

In the preferred form of the present invention, first lower shaft section 30 and second lower shaft section 32 are cylindrical in shape and are formed by independent tubular elements, each of which is connected by a lower end thereof to club head 16 and at an upper end to intermediate shaft portion 22. These tubular elements are constructed in a manner and of materials standard in the golf club industry. These tubular elements preferably are perpendicular to the length of club head 16 and are on either side of lower shaft axis A which passes through the center of club head 14. Club head 14, in turn, has a pair of attack faces 34 and 36 which are oriented on each side of the lower shaft plane. Attack faces 34 and 36 are preferably parallel to the lower shaft plane but, if desired, could be formed at an angle with respect thereto to provide the desired loft characteristics. Each attack face has a center area, such as area 50 on face 34, that forms a "sweet spot" used to hit the golf ball.

As is shown best in FIGS. 1 and 4, golfer 12 addresses golf ball 14 by placing the sweet spot of club head 16 adjacent golf ball 14. The golfer's line of view L is therefore along lower shaft axis A. Since handle axis C is offset from axis A, the golfer's hands, as well as handle portion 18, are not in this view line so that golfer 12 has an unrestricted view of lower shaft portion 20, club head 16 and golf ball 14. In the preferred embodiment of the present invention, and as shown in FIG. 4, lower shaft axis A is perpendicular to head axis B and handle axis C is parallel to lower shaft axis A. With this construction and, by properly weighting head 14 and handle portion 18, center of mass M of golf club 10 is geometrically located in intermediate shaft portion 22. As is shown in FIGS. 2 and 3, handle portion 18 is offset only in the lower shaft plane so that golf club 10 is symmetric and may be rotated 180° about lower shaft axis A for both left-handed and right-handed golfers. Shaft axis A passes through the center of club head 16 so that shaft sections 30 and 32 are located on either side of the sweet spot shown as area 50. Accordingly, when golfer 12 strikes golf ball 16, the forces of impact are uniformly distributed to club head 16 by shaft sections 30 and 32. Thus, the "sweet spot" corresponding to area 50 is flanked by the force applying elements in the form of shaft sections 30 and 32. Preferably, shaft sections 30 and 32 are oriented substantially parallel with respect to one another so that not only do they help distribute the forces of impact of the golf ball, but also the positioning of shaft sections 30 and 32 on either side of area 50 help the golfer visually align the golf ball 14 against the attack face 34 of club head 16.

While the above description has been directed to the preferred embodiment of the present invention, FIGS. 5–8 show a first alternate embodiment of this invention. This embodiment is substantially the same as that described with respect to golf club 10. However, in the alternate embodiment as shown in these figures, golf club 110 has a lower shaft portion 120 constructed somewhat differently than that described with respect to golf club 10. In FIGS. 5–8, it may be seen that intermediate shaft portion 122 is an integral, tubular extension of handle portion 118 and in turn forms the upper end 126 of lower shaft portion 120. In this embodiment, lower shaft sections 130 and 132 are not independent elements, but rather are an integral extension of this common tube and are formed by collapsing a diametric portion thereof. As is seen in these figures, this diametrically collapsed portion forms a web 150 that extends between first and second lower shaft sections 130 and 132 along their length. The formed lower shaft portion 120 is then attached in a suitable manner to club head 114.

Figure 9:
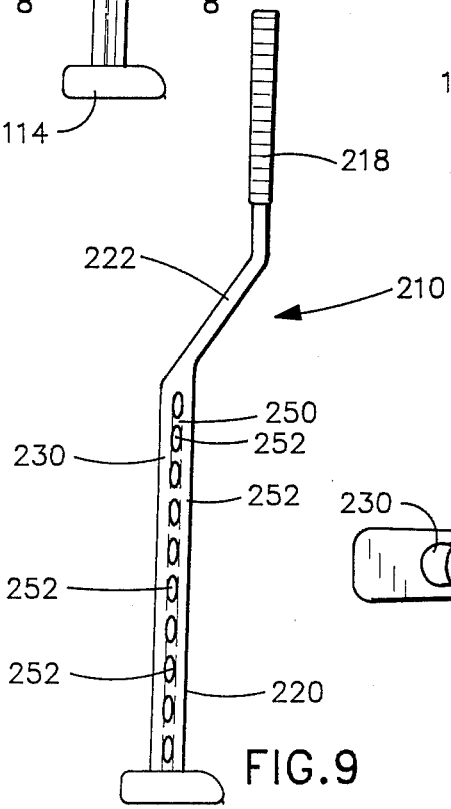
FIG. 9 is a side view in elevation of a second alternate embodiment of a golf club according to the present invention.
Figure 10:
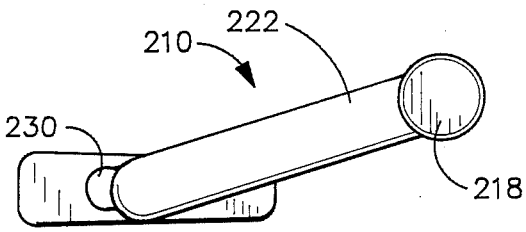
FIG. 10 is a top plan view of the embodiment of the present invention shown in FIG. 9.

A third embodiment of the present invention shown in FIGS. 9 and 10. In this embodiment, golf club 210 is similar in many respects to golf club 110. However in this third embodiment the web 250 between lower shaft sections 230 and 232 is provided with a plurality of openings or holes 252 along its length. These holes reduce the weight of lower shaft portion 220 to help balance club 210. Furthermore, as is shown in FIG. 10, golf club 210 has a handle portion 218 that is offset by intermediate portion 222 so that handle portion 218 is offset both in spaced relation to the lower shaft axis of lower shaft portion 220 and also in spaced relation to the lower shaft plane.

From the foregoing, it should be appreciated that the golf clubs according to this invention each provide a club head which is oriented transversely to the attack plane and which club head is provided with a perpendicular lower shaft portion that is secured by intermediate shaft portion to an offset handle that is grasped by the golfer. The handle portions and the lower shaft portions have axes that are parallel to one another. While the lower shaft may be oriented at any desired angle width with respect to the head axis of the club head, the axes of both the lower shaft portion and the handle portion are preferably perpendicular to the head axis. Furthermore, by providing the offset handle, neither the handle portion nor the golfer's hands restrict the view line for the golfer when the golf ball is stroked by the golfer. Thus, the golfer has an unrestricted view of the golf ball during the stroke. The handle portions and the lower shaft portions are preferably constructed to have a similar length, and the club is preferably weighted so as to have a center of mass in that portion that interconnects the offset handle and the lower shaft, and the lower shaft is formed as a pair of cylindrical sections which flank either side of the golf ball when it is addressed. Thus, the club has exceptional balance and uniformly distributes the impact force of the club of the golf ball and its construction helps visually align the ball for the golf stroke.

Accordingly, the present invention has been described with some degree of particularlity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A golf club having a selected length and adapted for use by a golfer in playing the game of golf, wherein the golfer swings the club in an attack plane parallel to the golfer's body to strike and propel a golf ball, comprising:

a club head located at a first end of the golf club and oriented transversely to the length of the golf club along a head axis;

a handle portion located at a second end of the golf club opposite the first end and adapted to be grasped by the golfer's hands;

a lower shaft portion formed of first and second lower shaft sections having first and second shaft section axes, said first and second lower shaft sections positioned in spaced apart side-by-side relation substantially perpendicular to the club head such that said first and second lower shaft section axes are on either side of a lower shaft axis and define a lower shaft plane transverse to the attack plane when the golfer holds the golf club in a position that addresses the golf ball; and an intermediate shaft portion interconnecting said lower shaft portion and said handle portion such that said handle portion has a handle axis and is offset from said lower shaft axis.

2. A golf club according to claim 1 wherein said first and second lower shaft sections are cylindrical in shape.

3. A golf club according to claim 2 wherein each of said first and second lower shaft sections are independent tubular elements each connected at a lower end thereof to said club head and at an upper end thereof to said intermediate shaft portion.

4. A golf club according to claim 2 wherein said first and second lower shaft sections are interconnected to one another along their length by a web element.

5. A golf club according to claim 4 wherein said web element has a plurality of holes therethrough.

6. A golf club according to claim 4 wherein said lower shaft portion is formed of a tubular member diametrically collapsed along a portion of its length to define a collapsed portion and a pair of tubular portions, said collapsed portion further defining said web and the pair of tubular portions defining said first and second lower shaft sections.

7. A golf club according to claim 1 wherein said handle portion is offset from said lower shaft axis a sufficient distance whereby the handle portion and the golfer's hands do not restrict a view line for the golfer along the lower shaft axis.

8. A golf club according to claim 7 wherein said handle portion lies in the lower shaft plane.

9. A golf club according to claim 7 wherein said handle portion is in spaced relation both to the lower shaft plane and to a plane which is perpendicular to the lower shaft plane and which contains the lower shaft axis.

10. A golf club according to claim 1 wherein said handle axis is parallel to said lower shaft axis.

11. A golf club according to claim 1 wherein said club head has first and second attack faces, one of said attack faces being located on each side of said lower shaft plane, said lower shaft plane containing said head axis.

12. A golf club according to claim 11 wherein said attack faces are parallel to said lower shaft plane.

13. A golf club according to claim 1 wherein said lower shaft portion and said handle portions have a similar linear dimension and wherein the golf club has a center of mass geometrically located in the intermediate shaft portion.

14. In a golf club including an upper handle portion oriented along a handle axis and adapted to be grasped by a golfer's hands and a lower club head oriented along a head axis and having an attack face parallel to the head axis, said attack face operative to strike and propel a golf ball when the golf club is swung in an attack plane by the golfer, the improvement comprising a shaft structure interconnecting said handle portion and the club head, said shaft structure including a lower shaft portion having a lower end attached to the club head and formed by first and second spaced apart shaft sections positioned in side-by-side relation respectively along first and second shaft section axes on either side of a lower shaft axis and defining a lower shaft plane that contains said lower shaft axis and is either substantially parallel to the head axis or coincident therewith, and including an intermediate shaft portion interconnecting an upper end of said lower shaft portion and a lower end of said handle portion whereby said handle axis is offset with respect to said lower shaft axis.

15. The improvement according to claim 14 wherein said lower shaft axis passes through the center of said club head with said shaft section axes being equidistantly spaced on either side of said lower shaft axis.

16. The improvement according to claim 14 wherein said lower shaft sections are formed as independent cylindrical elements.

17. The improvement according to claim 14 wherein said lower shaft portion, said intermediate shaft portion and said handle portion are constructed of an integral tube, said first and second lower shaft sections being formed by a diametrically compressed portion of said tube along the length of the lower shaft portion to separate said tube into two substantially parallel tube sections, said collapsed portion forming a web therebetween.

18. The improvement according to claim 14 wherein said first and second shaft axes and said handle axes are substantially parallel to one another.

19. The improvement according to claim 18 wherein said handle axis is located in the lower shaft plane.

20. A golf club having a selected length and adapted for use as a putter in playing the game of golf wherein the golfer putts a ball by swinging the golf club along an attack plane, comprising:

a club head located at one end of the golf club and having a length along a head axis transverse to the attack plane and a pair of attack faces;

a lower shaft portion attached to the club head at a central location, said lower shaft portion extending perpendicularly of said club head along a lower shaft axis perpendicular to said head axis;

a handle portion located at the other end of said golf club opposite said one end, said handle portion having a longitudinal handle axis; and an intermediate shaft portion interconnecting said lower shaft portion and said handle portion such that said handle portion is offset from said lower shaft portion, the length of said handle portion and said lower shaft portion, the length of said handle portion and said lower shaft being substantially equal with the golf club being weighted such that its center of mass is located in said intermediate shaft portion, said golf club being rotatably symmetric about said lower shaft axis so that said golf club may be equivalently used by left-handed and right-handed golfers.

21. A golf club according to claim 20 wherein said handle axis lies in a plane containing the lower shaft axis and the head axis.

22. A golf club according to claim 21 wherein said handle axis is parallel to said lower shaft axis.

23. A golf club according to claim 20 wherein said lower shaft portion is formed by a pair of parallel lower shaft sections spaced from one another a sufficient distance to flank a golf ball addressed by a selected one of the attack faces whereby the golfer may sight down a view line corresponding to said lower shaft axis thereby locating the golf ball centrally of the attack face.

* * * * *